US005706551A

United States Patent [19]

Jeynes et al.

[11] Patent Number: 5,706,551

[45] Date of Patent: Jan. 13, 1998

[54] DOOR CLOSERS AND DAMPERS PRIMARILY FOR DOOR CLOSERS

[75] Inventors: Roger Henry Jeynes, Birmingham; John Humpherson, Loughborough, both of United Kingdom

[73] Assignee: Samuel Heath & Sons PLC, West Midlands, United Kingdom

[21] Appl. No.: 624,540

[22] PCT Filed: Aug. 4, 1995

[86] PCT No.: PCT/GB95/01853

§ 371 Date: Jun. 10, 1996

§ 102(e) Date: Jun. 10, 1996

[87] PCT Pub. No.: WO96/05397

PCT Pub. Date: Feb. 22, 1996

[30] Foreign Application Priority Data

Aug. 12, 1994 [GB] United Kingdom ..... 9416376

[51] Int. Cl.[6] ..... E05F 3/04

[52] U.S. Cl. ..... 16/59; 16/61

[58] Field of Search ..... 16/56, 59, 61, 16/67, 63, 71, 58

[56] References Cited

U.S. PATENT DOCUMENTS

| | | | |
|---|---|---|---|
| 3,487,494 | 1/1970 | deBaan et al. . | |
| 3,887,961 | 6/1975 | Saajos . | |
| 4,115,897 | 9/1978 | Zunkel . | |
| 4,317,254 | 3/1982 | Chaddock | 16/61 |
| 4,376,323 | 3/1983 | Tillmann | 16/71 |
| 4,414,703 | 11/1983 | Schnarr et al. . | |
| 5,259,090 | 11/1993 | Fayngersh . | |

FOREIGN PATENT DOCUMENTS

| | | |
|---|---|---|
| 0016445 | 12/1982 | European Pat. Off. . |
| 2279917 | 2/1976 | France . |
| 1103857 | 2/1968 | United Kingdom . |
| 2268540 | 1/1994 | United Kingdom . |

*Primary Examiner*—Chuck Y. Mah
*Assistant Examiner*—Mark Williams
*Attorney, Agent, or Firm*—Webb Ziesenheim Bruening Logsdon Orkin & Hanson, P.C.

[57] ABSTRACT

A door closer for hingedly mounted doors comprises an actuator adapted for fitting within the thickness of a door and an anchor member adapted for fitting in a door frame such that when installed the closer acts to draw the door into a position of closure at a rate controlled by a fluid-filled damper which comprises a cylinder containing hydraulic fluid, a piston slidable longitudinally of said cylinder and dividing the cylinder into two chambers and a flow restriction assembly associated with the passageway incorporated in said piston to limit the rate of flow of hydraulic fluid from one chamber to the other when the piston is moving in the door-closing direction. The flow restriction assembly defines a flow-restricting passageway including a slot and to enable to flow restriction imposed on the hydraulic fluid to be adjusted when the door closer is installed and in use, the effective length of the slot is variable by relative positional adjustment of two elements by which the slot is defined. An adjustment member is provided within the cylinder to enable one of said passageway-defining elements to be positionally adjusted relative to the other so as to vary the flow restriction imposed on the hydraulic fluid by the slot, the adjustment member having an operating element which is accessible end-wise of the damper.

30 Claims, 4 Drawing Sheets

DOOR CLOSERS AND DAMPERS PRIMARILY FOR DOOR CLOSERS

BACKGROUND OF THE INVENTION

This invention concerns door closers of the kind comprising an actuator intended for concealed fitting within the thickness of a door and an anchor member for fixing to a door frame, and in which a tension member coupled to said anchor member is slidably movable Within the actuator under the action of spring means, and under the control of a uni-directionally operative fluid-filled damper which serves to regulate the rate of movement of the door in the direction of closure without significantly restricting the rate of movement of the door in the direction of opening. The invention also concerns dampers primarily for such door closers.

It is desirable for the action of the damper in such a door closer to be adjustable so as to enable the rate of closure to be set to fall within a chosen range despite variations in the weight and other parameters of different doors with which the closer may be used.

Many different types of door closer are known.

One type, typified by U.S. Pat. No. 4,115,897, includes a main body adapted for fitting onto the face of a door with an articulated arm which is secured to the door frame. The arm is acted upon by a rotary spindle which projects from the body in a direction transverse to that in which a driving compression spring acts. Variable restrictor valves are provided to enable the rate of closure to be adjusted after installation, and because the body is entirely accessible this presents no design problems.

A somewhat similar closer, as shown in FR2279917 is adapted for mounting within the thickness of the door at the upper edge thereof, and includes a block-like body to be located in a recess formed in the top edge of the door. A flow-restricting orifice controls the rate of flow of fluid in the damper and adjustment of the rate of closure is available by means of an axially adjustable obturating member operable by means of a thumb-wheel which is disposed at one end of the body and exposed at the upper edge of the door within the recess formed to receive the body. Again, because the body is at least partially accessible at the top edge of the door, and the arm is acted upon by a rotary spindle which does not obstruct the ends of the body, it is not difficult to provide for the required adjustment.

Another type of closer utilises an actuating member which is movable lineally. For example, U.S. Pat. No. 3,887,961 discloses a closer for a sliding door in which a spring-driven rod carries a lineally movable piston in a cylinder serving as a damper, a fluid by-pass between the ends of the cylinder having an adjustable needle valve to regulate the rate of flow and hence the rate of closure. In this case, the closer is mounted on top of the door and accordingly the needle valve is readily accessible for adjustment.

By contrast, where a linear closer is to be concealed within a door there is generally no ready access to the flow-rate controlling orifice once the closer is installed.

For example, GB 1103857 shows such a closer in which the flow-rate control orifice is formed as a narrow groove in the face of a piston-like member which is overlaid by a spring-loaded washer. During closure movement, the washer is pressed against the face of the piston, and liquid can flow to the other side of the piston only by passing through the groove, which exerts the required restriction. During opening movement, the disc is allowed to lift from the face of the piston and open an alternative, relatively unrestricted passageway. No adjustment of the effect of the groove is possible as the piston which carries the flow-rate control orifice is not readily accessible.

However, an adjustable spring-loaded buffer member is provided to cushion movement of the piston at the end of the door-closing stroke. This buffer member is disposed at the inner end of the tubular body. To enable the buffer member to be adjusted, so as to regulate the closure position of the door relative to the door frame, it is proposed that the buffer member is movable longitudinally of the body by means of a screw which extends axially from the innermost end of the tubular body and carries a toothed adjustment wheel accessible through an aperture formed in the top edge of the door, the closer necessarily being mounted close to the top edge of the door for this purpose.

It is, however, generally undesirable to form such an aperture in the door, and indeed it is generally undesirable to arrange such a concealed door closer adjacent to the top edge of the door.

Generally, it is to be preferred to arrange such a closer at about mid-height within the door, so that the closure force is more evenly balanced and the integrity of the top edge of the door is not compromised. Where the closer is arranged in this way, it would be undesirable to provide an aperture in one of the main faces of the door for access to such adjustment wheel, partly because it would be unsightly, and partly because it would disrupt the integrity of the facing layer of the door in a manner which would not be acceptable in, for example, a fire-resistant door.

In EP 0016445, there is a proposal for effecting adjustment of the final part of the closure movement of the door without requiring an aperture to be formed in the door, other than for the reception of the body of the closer itself. In the preferred arrangement, the required adjustment is achieved by means of an adjustment member associated with the anchor member which is attached to the door frame, the adjustment member being disposed behind a mounting plate of the anchor member at a variable spacing so as effectively to adjust the length of the coupling between the tension member in the actuator and the anchor member. This arrangement does not make any provision for adjustment of the overall rate of closure, but only in the final closure position of the door relative to a final part of the travel of the piston in the door-closing direction, in which final part of the travel the action of the damper is rendered ineffective so as to provide for a locally increased rate of closure movement to overcome any resistance which may be offered by a door latch for example.

In addition, EP 0016445 discloses an alternative, less-preferred arrangement in which the position of the piston in the damper in the door-closed position is adjustable longitudinally of the damper cylinder by rotation of the piston rod which carries it, the forward end of the rod being accessible, when the door is open, through an aperture formed at the outer end of the actuator body at the hinge edge of the door.

In neither arrangement is there any provision for adjustment of the rate of closure generally over the whole range of movement of the door, as the piston on which the flow restriction device is carried is not readily accessible. Accordingly, it is an object of the present invention to make provision for adjustment of the overall rate of closure, throughout the whole range of movement, in a concealed door closer of the kind in which a tension member is slidably movable within an actuator mounted within the thickness of the door and coupled to an anchor member secured to the door frame, and without requiring the formation of any aperture in the door other than that in which the actuator is mounted, but which enables such adjustment to be carried out whilst the closer is assembled with the door and frame.

SUMMARY OF THE INVENTION

According to a first aspect of the invention we provide a door closer comprising:

(a) an actuator comprising a housing adapted for fitting within the thickness of a door and having a mounting plate for securing to an edge face of the door at which the door is hinged;

(b) an anchor member adapted for fitting in a door frame in opposed relation to said edge face of the door;

(c) a tension member slidably movable within the actuator housing under the action of spring means and coupled to said anchor member so that said spring means acts to draw the housing and the anchor member together such that, when installed, the closer acts to draw the door towards and into a position of closure relative to the door frame; and (d) a fluid-filled damper coupled to said tension member and arranged to regulate the rate of movement of the tension member under the force of said spring means at least in a door-closing direction, the damper comprising:

(i) a cylinder containing hydraulic fluid;

(ii) a piston slidable longitudinally of said cylinder and dividing the cylinder into two chambers;

(iii) a piston rod carrying said piston and extending beyond said cylinder at one end thereof; and (iv) a flow-restricting passageway incorporated in said piston to limit the rate of flow of hydraulic fluid from one of said chambers to the other at least when the tension member is moving in the door-closing direction, said passageway being defined by two elements in combination;

wherein:

(e) the flow restriction imposed on the hydraulic fluid by said passageway is variable by relative positional adjustment of said two passageway-defining elements and an adjustment member is provided within the cylinder to enable one of said passageway-defining elements to be positionally adjusted relative to the other so as to vary the flow restriction imposed on the hydraulic fluid by said passageway, the adjustment member having an operating element which is accessible at said actuator mounting plate.

In a preferred arrangement the passageway includes an arcuate slot of variable effective length.

The passageway-defining elements may comprise respective discs, one of which is formed with said arcuate slot centred on the axis of the piston rod and held against rotation relative to said piston rod, one end of the slot communicating with a through-bore formed in said piston, and the other of said discs is formed with a through-aperture to register with said arcuate slot, whereby rotation of the apertured disc varies the effective length of the slot (between the through-bore of the piston and the aperture), engagement of the adjustment member and the apertured disc enabling the apertured disc to be rotated relative to the slotted disc.

In an alternative arrangement, there may be a single such disc formed with said through-aperture, the slot being formed in the face of the disc which contacts the piston and/or in the face of the piston which contacts the disc, the through-bore in the piston opening into one end of said slot.

In a preferred embodiment, the cylinder is open at the end thereof adjacent to said mounting plate, and said piston rod extends away from the mounting plate through a seal at the opposite closed end of the cylinder which defines one end of one of said chambers, and the cylinder contains between said piston and its open end an additional, free piston which defines one end of the other of said chambers.

In one such arrangement said adjustment member may be carried by said free piston for longitudinal movement relative to said free piston so as to be engageable with one of said passageway-defining elements for the purpose of positional adjustment thereof, the operating element of the adjustment member extending through said free piston towards said open end of the cylinder. In this arrangement, the free piston may be formed with a central bore in which the adjustment member is slidably and rotatably received.

In an alternative arrangement the free piston may itself be adapted to serve as said adjustment member.

In either case, the operating element of the adjustment member may be formed or provided at the end of the free piston nearer to the mounting plate and include a formation adapted to co-operate with an adjusting tool which can be inserted through an aperture formed in said mounting plate whereby the adjustment member can be moved longitudinally into engagement with one of said passageway-defining elements, and rotationally so as to adjust the circumferential position of said passageway defining element.

Such arrangements are suitable where the cylinder is secured immovably relative to the mounting plate of the closer and the tension member is coupled to the piston rod. In an alternative arrangement, the piston rod may be secured immovably relative to the mounting plate, and the cylinder coupled to the tension member. In such a case, the adjustment member may comprise a tubular shaft mounted on the fixed piston rod and carrying at its inner end one of said passageway-defining elements, with said operating element at the outer end of the tubular shaft.

Instead of the passageway being formed as an arcuate slot of an effectively adjustable length, the passageway could be defined by a first one of said elements which defines a bore and a second one of said elements arranged co-axially within said bore so that the passageway is of annular form, with a minimum cross-sectional area which is variable by relative longitudinal adjustment of the two elements. Such an arrangement would be particularly applicable in the case of a door closer in which the piston rod is fixed relative to the mounting plate and the cylinder is movable.

According to a second aspect of the invention we provide a fluid-filled damper comprising:

(i) a cylinder containing hydraulic fluid;

(ii) a piston slidable longitudinally of the cylinder and dividing the cylinder into two chambers;

(iii) a piston rod carrying said piston and extending beyond said cylinder at one end thereof; and (iv) a flow-restricting passageway incorporated in said piston to limit the rate of flow of hydraulic fluid from one of said chambers to the other at least in one direction of flow, said passageway being defined by two elements in combination:

wherein:

(v) the flow restriction imposed on the hydraulic fluid by said passageway is variable by relative positional adjustment of said two passageway-defining elements, and an adjustment member is provided within the cylinder to enable one of said passageway-defining elements to be positionally adjusted relative to the other so as to vary the flow restriction imposed on the hydraulic fluid by said passageway, the adjustment member having an operating element which is accessible endwise of the cylinder.

In a preferred embodiment, the cylinder may be closed at the end thereof through which the piston rod extends so as to define one of said chambers between such closed end and the piston carried by the piston rod, and the other end of the cylinder may be open, with an additional, free piston, slidable within the cylinder between the piston carried by the piston rod and the open end of the cylinder so as to define the other of said chambers. In this case, the adjustment member may be carried by the free piston in such a manner as to be longitudinally movable relative to said free piston for the purposes of engagement with one of said passageway-defining elements to enable said one element to be positionally adjusted relative to the other, the operating element of the adjustment member extending through said free piston towards the open end of the cylinder.

The passageway-defining elements may comprise respective discs, one of which is formed with said arcuate slot centred on the axis of the piston rod and held against rotation relative to said piston rod, one end of the slot communicating with a through-bore formed in said piston, and the other of which discs is formed with a through-aperture to register with said arcuate slot, whereby rotation of the apertured disc varies the effective length of the slot (between the through-bore of the piston and the aperture), engagement of the adjustment member and the apertured disc enabling the apertured disc to be rotated relative to the slotted disc.

In an alternative arrangement, there may be a single such disc formed with said through-aperture the slot being formed in the face of the disc which contacts the piston and/or in the face of the piston which contacts the disc, the through-bore in the piston opening into one end of said slot.

BRIEF DESCRIPTION OF THE DRAWINGS

These and other features of the invention will now be described by way of example with reference to the accompanying drawings wherein.

DETAILED DESCRIPTION OF THE INVENTION

Figure 1:
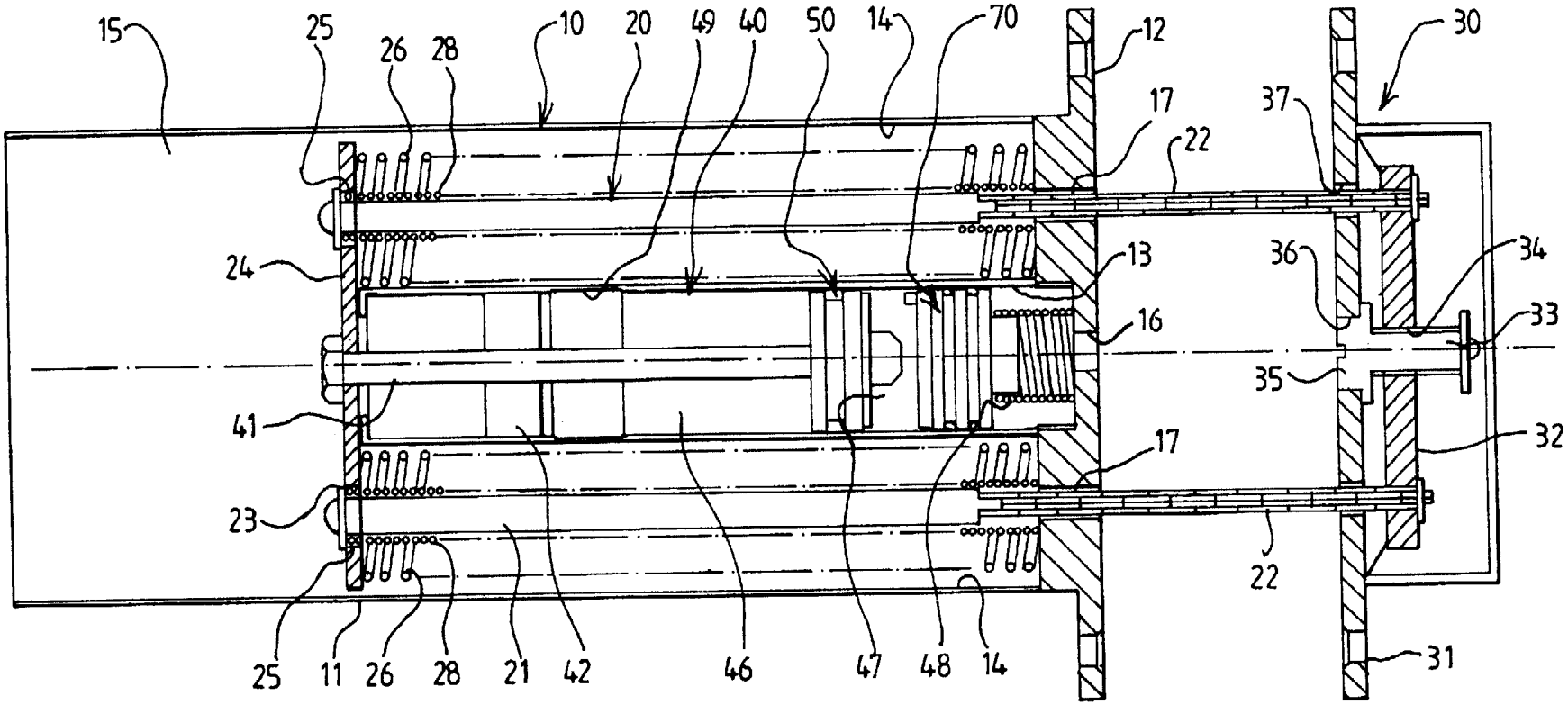
FIG. 1 illustrates diagrammatically one embodiment of door closer to which the invention is applied.
Figure 2:
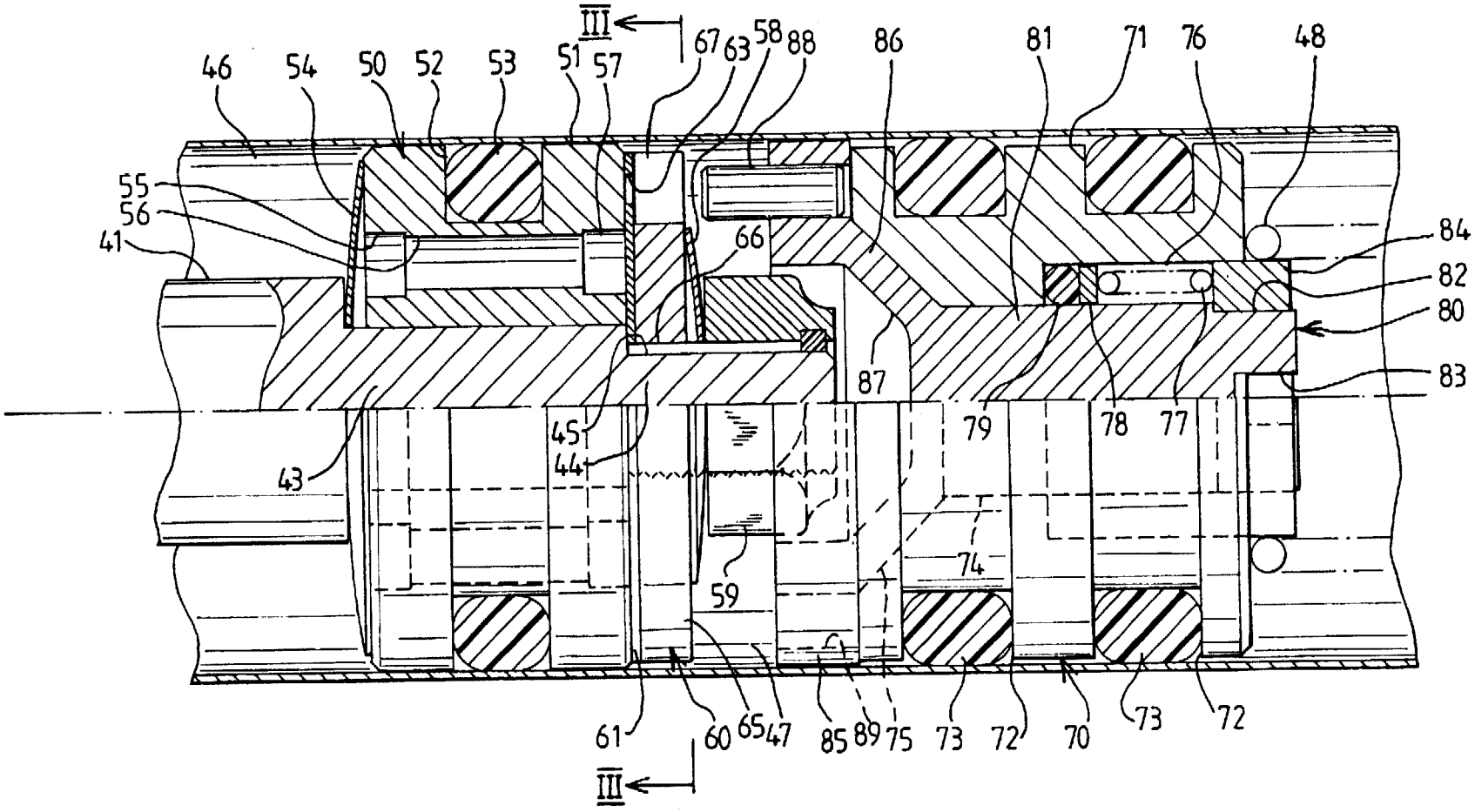
FIG. 2 is a diametral half section through part of a damper for incorporation in such a closer, showing the construction of a piston carried by a piston rod and a free piston which carries an adjustment member.
Figure 3:
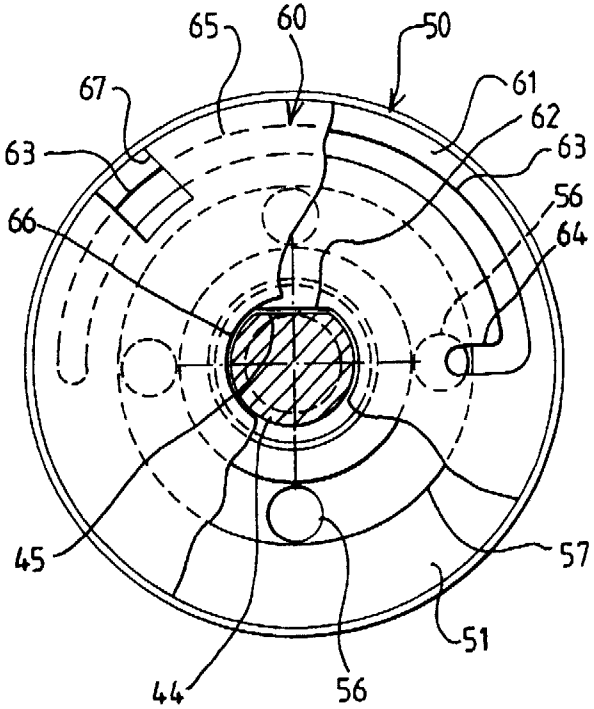
FIG. 3 is a view on the line III—III of FIG. 2 showing various components partially broken away.

As illustrated in FIGS. 1 to 3, a preferred embodiment of door closer comprises an actuator 10 including a body 11 which is so dimensioned as to be suitable for fitting within the thickness of a door and is provided with a mounting plate 12 which is adapted to be secured at an edge face of the door at which hinges are provided whereby the door is pivotally connected to an associated door frame. The body 11 is formed with a central, longitudinally extending bore 13 and respective lateral bores 14 on either side thereof. The bores 13 and 14 open into a hollow space 15 at the end of the body remote from the mounting plate, which itself is formed with a central opening 16 on the axis of the central bore 13 and respective lateral openings 17 on the axes of the lateral bores 14.

The actuator further includes a tension member 20 which comprises respective shafts 21 disposed coaxially within the bores 14, each shaft, at the end nearest the mounting plate, being connected with a respective articulated chain 22 which extends through the corresponding opening 17 in the mounting plate 12. Abutment washers 23 are secured to the ends of the shafts 21 remote from the chains, and the shafts carry a cross-head 24 which is disposed within the hollow space 15. The shafts 21 extend through apertures 25 in the cross-head 24 so that the latter is longitudinally slidable relative to the shafts.

Main compression springs 26 are disposed within the bores 14 so as to act between the cross-head 24 and the opposite end of the body 11 so that the tension member 20 as a whole is drawn into the body 11 by the force of the springs 26 acting on the cross-head 24, which in turn bears on the washers 23 to drive the shafts 21 longitudinally inwardly of the body.

Tension-maintaining springs 28 are located on the shafts 21 and extend through the apertures 25 in the cross-head so as to bear at one end on the washers 23 and act between such washers and the forward end of the body 11. The springs 28 serve to maintain tension in the articulated chains 22, and prevent them from buckling and thereby possibly jamming, if the chains are driven inwardly of the housing by an external force at a rate faster than the cross-head 24 is driven inwardly by the main compression springs 26.

The closer further comprises an anchor member 30 which is adapted for mounting on the associated door frame at the edge thereof facing the hinged edge of the door at which the actuator 10 is installed. The anchor member comprises a mounting plate 31 and an adjustment plate 32 which is spaced from the mounting plate on the side thereof remote from the actuator 10 by an adjustable distance. An adjusting screw 33 is engaged in a threaded hole 34 formed in the adjustment plate 32 and a head portion 35 of the screw 33 is located in a hole 36 in the mounting plate 31 so that by rotation of the screw 33 by means of a suitable tool such as a screwdriver, the spacing of the adjustment plate 32 relative to the mounting plate 31 may be varied.

The articulated chains 22 extend through apertures 37 in the mounting plate 31 and are secured at their free ends to the adjustment plate 32. Positional adjustment of the adjustment plate 32 various the position of the cross-head 24 within the body 11 relative to the mounting plate 12 of the body 11 when the closer is installed and the door is in its position of closure relative to the associated door frame, for the purpose hereinafter mentioned.

To regulate the rate of movement of the tension member 20 under the force of springs 26, and hence to regulate the rate of closure of the door, the central bore 13 of the body 11 contains an hydraulic damper 40. The damper 40 includes a piston rod 41 secured to cross-head 24 and extending towards the mounting plate 12 through a sealing bushing 42 which closes the end of the damper. The piston rod 41 terminates at its free end in a reduced diameter portion 43 (FIG. 2) which itself is formed with an extension in the form of a threaded spigot 44 having a flat face 45 for the purpose hereinafter described.

A piston 50 is located on the reduced diameter portion 43 of the piston rod 41 and in combination with the bushing 42 defines an inner chamber 46 which is filled with hydraulic fluid. An outer chamber 47, also filled with hydraulic fluid, is defined. between the piston 50 and a free piston 70 which is urged towards the piston 50 by means of a spring 48 acting between the free piston and the forward end of the body 11.

The bore 13 may itself define the cylinder within which the pistons 50 and 70 move, or alternatively a separate cylinder may be located within the bore 13 so that the damper 40 then comprises a pre-assembled unit separate from the body 11 itself.

In either case, an annular rebate 49 is formed in the cylindrical surface over which the piston 50 travels at a position near the bushing 42, so that the restriction imposed by the damper on the inward movement of the tension member 20 is relieved as the piston 50 enters the rebated portion of the cylinder. The rebate 49 is so located that it becomes effective as a fluid by-pass over the final stage of the movement of the door towards its position of closure, so as to provide an increased closing force to overcome resistance which may arise from the operation of a latch or other such device associated with the door. Adjustment of the adjustment plate 32 enables the closer to be adjusted to compensate for the width of the gap between the edge of the door and the door frame, which may vary in different installations, and to ensure that the fluid by-pass afforded by the rebate 49 becomes operative at an appropriate point in the travel of the door towards its position of closure.

As seen most clearly in FIG. 2, the piston 50 comprises a piston head 51 formed with an external groove 52 for an O-ring 53. A spring washer 54 acts between the piston head 51 and the shoulder formed on the piston rod 41 by the reduced diameter portion 43. The piston head 51 is formed with an annular recess 55 at the side facing the shoulder and the spring washer 54 is in the form of a "spider" or is otherwise of apertured form so that hydraulic fluid within the inner chamber 46 enters the recess 55. A plurality of circumferentially spaced bores 56 extend from the recess 55 to a similar annular recess 57 at the opposite face of the piston 51, with which there is associated a flow restriction assembly 60 which is located on the threaded spigot 44 and retained by means of a spring washer 58 engaged by a locking nut 59.

The assembly 60 comprises a thin disc 61 having a D-shaped aperture 62, the straight edge of which engages the flat face 45 of the threaded spigot 44 so that the disc 61 is held against rotation relative to the adjacent piston head 51. The disc 61 is formed with an arcuate slot 63 which, in the illustrated embodiment, subtends an angle of 180° about the axis of the piston rod 41. The arcuate slot 63 is disposed outwardly of the annular recess 57 in the piston head 51 and is formed at one end with a radially inward extension 64 which overlaps with the recess 57, thereby placing the slot 63 in communication with the recess 57 and thence, by way of the bores 56 and annular recess 55, with the inner chamber 46.

The disc 61 is held against the piston head 51 by means of a disc-like support plate 65 on which the spring washer 58 bears. The support plate 65 is formed with a central aperture 66 of circular shape so that it is able to rotate about the axis of the piston rod relative to the fixed disc 61.

The support plate 65 is formed with a notch 67 at one point in its periphery, which forms a circumferentially adjustable port to communicate with the slot 63 at any position along the length of the latter. The port afforded by the notch 67 places the slot 63 in communication with the outer chamber 47 of the damper thereby enabling fluid to be transferred from one chamber to the other through the arcuate slot 63 which is so dimensioned as to serve as a flow-restricting passageway of constant cross-section and variable length.

It will be understood that the flow restriction imposed will depend on the effective length of the passageway between the radial extension 64 of the slot and the notch 67, the greater the length of the passageway the greater the restriction.

The free piston 70 comprises an annular body 71 formed with external grooves 72 receiving respective O-rings 73. The annular body 71 defines a central cylindrical bore 74 which opens into a frusto-conical recess 75 at the end of the body facing the piston 50. The central bore 74 is formed with a circumferential rebate 76 at the end thereof opposite the frusto-conical recess 75.

An adjustment member 80 is slidably and rotatably received within the bore 74 of the annular body 71. The adjustment member comprises an axial stem 81 having a reduced diameter end portion 82 at the end thereof facing the mounting plate 12 of the body 11. Such end portion serves as an operating element and is formed with a transverse slot 83 for the reception of a screwdriver blade, or any other appropriate formation for engagement with an adjustment tool as hereinafter described. A retaining ring 84 is secured, for example adhesively, to the outer face of the end portion 82, and the external diameter of the ring 84 is such as to enable it to enter the rebated portion of the bore 74.

A compression spring 77 acts between the ring 84 and a washer 78 which bears on an O-ring 79 at the inner end of the rebate 76 so as to seal the stem 81 of the adjustment member relative to the annular body 71.

The adjustment member is formed with a disc-like head 85 which is united with the stem 81 through an intermediate, frusto-conical portion 86. The head 85 and frusto-conical portion 86 are formed with a recess 87 which, as illustrated in FIG. 2, can accommodate the nut 59 at the end of the piston rod 41 when the piston 50 is driven to the forward end of its stroke. The outer chamber 47 is then at its minimum volume, which is determined by the quantity of hydraulic fluid present in the damper. This quantity is selected so as to ensure that there is pre-determined minimum spacing between the head 85 of the adjustment member 80 carried by the free piston 70 and the support plate 65 carried by the piston 50.

The head 85 of the adjustment member 80 carries an axially projecting pin 88 at a position which is radially offset from the axis of the bore 13 by such a distance that the pin 88 can enter the notch 67 of the support plate 65, the pin itself being so dimensioned as to be capable of entering the notch.

The adjustment member may be operated by means of a suitable tool, such a screwdriver, inserted through the central opening 16 in the mounting plate 12 of the body 11. Such tool may be used to displace the adjustment member 80 axially relative to the annular body 71 of the free piston 70 against the force of spring 77, the head 85 having a through-bore 89 to allow fluid to pass behind the head as it is moved until the free end of the pin 88 bears against the face of the support plate 65, assuming that the pin 88 is not aligned with the notch 67. The adjustment member 80 may then be rotated, whilst maintaining an axial force, so that the pin 88 can be brought into register with the notch 67, thus allowing the adjustment member to move further so that the pin 88 enters the notch 67. Thereafter, rotation of the adjustment member 80 by means of the tool will adjust the circumferential position of the notch 67 relative to the arcuate slot 63, thereby adjusting the effective length of the flow-restricting passageway defined by the slot.

It will be understood that such adjustment can be effected when the closer is installed by opening the door to its fullest extent, thereby driving the piston 50 fully towards the free piston 70 until the cross-head 24 is restrained against further movement towards the mounting plate 12 by reaching its limit of travel within the hollow space 15. The piston 50 is then at its closest to the free piston 70, as illustrated in FIG. 2, and the required adjustment can be effected.

In this way, the time required for closure of a door from a 90° position a position of closure can be varied from a minimum of two seconds or less to a maximum of twenty five seconds or more after the closer has been installed. This enables a required closure rate to be set despite differences between weights of different doors and other Variable external influences which affect the rate of closure, such as friction in hinges.

The flow restricting assembly 60 is so designed as to be operative only when the piston 50 is travelling in a direction away from the mounting plate, i.e in the door-closing direction. Spring washer 58 holds the disc 61 against the shoulder defined between the threaded spigot 44 and the reduced diameter portion 43 of the rod 41, whilst spring washer 54 presses the piston head 51 against the disc 61, the force of the spring washer 54 being augmented by hydraulic pressure in the inner chamber 46 as the piston moves inwardly. However, when the piston moves in the opposite direction as the door is opened, hydraulic pressure established in the outer chamber 47 overcomes the force of the spring washer 54, which is thereby flattened by inward movement of the piston head 51 towards the shoulder defined between the main part of the piston rod 41 and the reduced diameter portion 43. This movement gives rise to a gap between the piston head 51 and the disc 61, thereby allowing fluid to flow through such gap and around the edges of the disc 61 and support plate 65, and effectively by-passing the resistance created by the slot 63 when the piston is moving inwardly so as not to impose any restriction on the rate at which the door may be opened manually.

Figure 4:
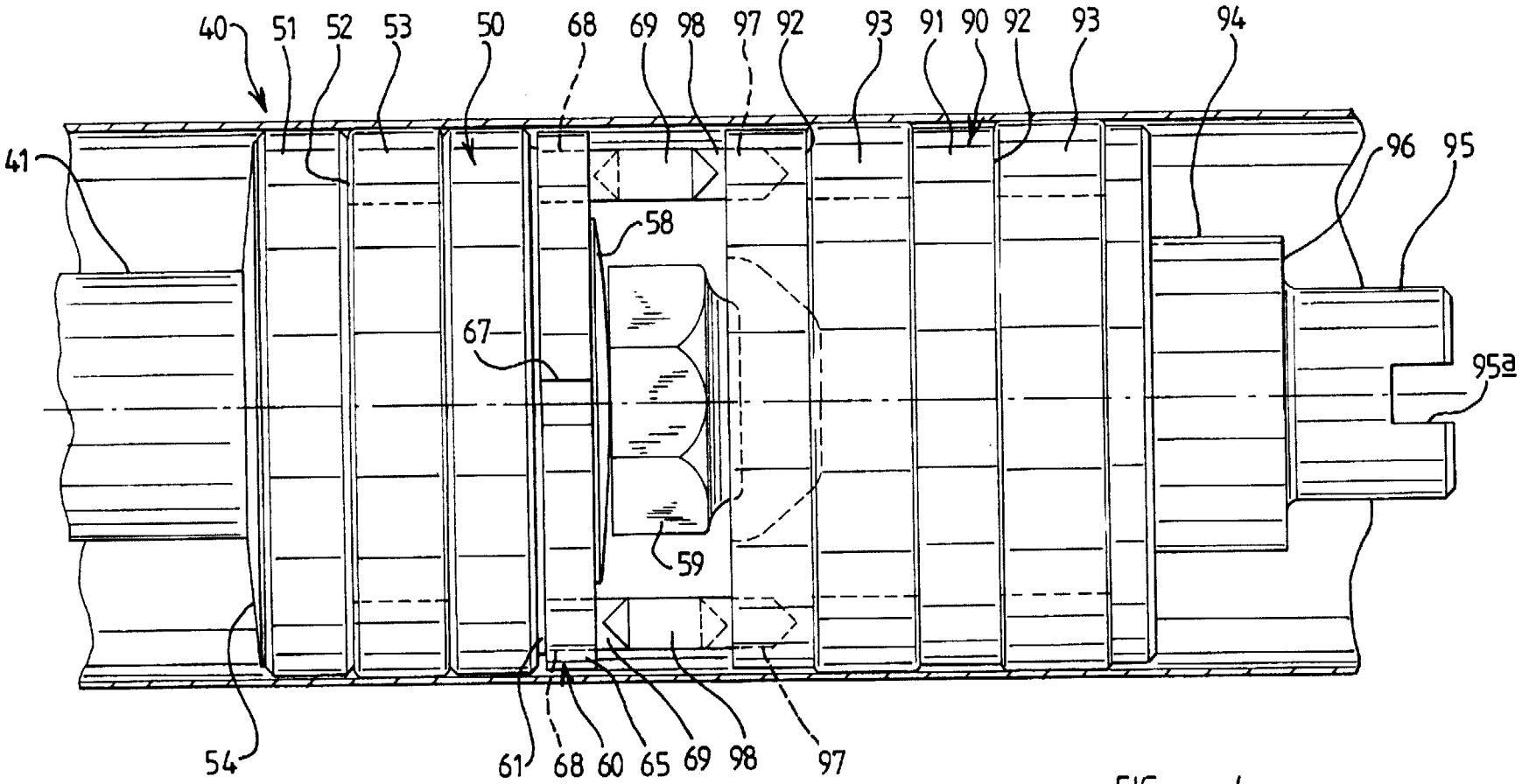
FIG. 4 is a fragmentary view of a modified damper showing an alternative construction of free piston which is adapted to serve as an adjustment member.

Turning now to FIG. 4, this illustrates a modification of the above-described closer which is generally similar to that described above, except that it employs an alternative form of free piston 90 which also serves as an adjustment member. Externally, the free piston/adjustment member 90 is generally similar to the free piston 70, comprising a cylindrical body 91 formed with external grooves 92 receiving respective O-rings 93. A frusto-conical recess, similar to the recess 75, is formed at the end of the body 91 facing the piston 50 for the same purpose. At the end of body 91 facing the mounting plate 12 the piston is formed with a reduced diameter extension 94 with an axially extending central spigot 95 formed at its free end with transverse slot **95*a***.

The diameter of the spigot 95 is such as to enable it to enter the central opening 16 in the mounting plate 12 when the piston 50 is at the end of its range of travel nearest to the mounting plate. An annular shoulder 96 around the spigot 95 is arranged to abut the mounting plate 12 around the opening 16, if necessary, to limit movement of the free piston/adjustment member 90.

It will be appreciated that the application of a blade of a screwdriver or the like to the slot **95*a* at the free end of the spigot 95 will enable the free piston/adjustment member 90, if necessary, to be displaced axially towards the piston 50**, and to be rotated about the axis of the cylinder in which the pistons move.

Whilst, with such an arrangement the free piston/adjustment member 90 could carry a pin, similar to the pin 88, to enter the notch 67 formed in the support plate 65, as described in the embodiment illustrated in FIG. 2, FIG. 4 illustrates an alternative manner of establishing a connection, which it will be understood may be used also in the FIG. 2 embodiment in which the adjustment member 80 is slidable relative to the free piston 70.

In this alternative arrangement, instead of a pin 88 being provided to enter the notch 67 in the support plate 65, the support plate carries at least one pin which projects towards the free piston/adjustment member 90 at substantially the same radial distance from the axis of the cylinder as a pin provided on the free piston/adjustment member 90. In the arrangement illustrated in FIG. 4, the support plate 65 and the free piston/adjustment member 90 are each provided with two diametrally opposed pins, but it will be appreciated that only one such pin may be provided on each component.

As can be seen from FIG. 4, the support plate 65 is formed with a pair of threaded bores 68, at diametrally opposed positions offset by 90° around the periphery of the plate from the notch 67, and a respective pin 69 is located in each of these bores.

In a similar manner, the end face of the free piston/adjustment member 90 is formed with a pair of axial bores 97 at diametrally opposed locations, and a respective pin 98 is located in each of the bores 97.

Over most of the range of movement of the piston 50 within the cylinder, the spacing between the piston 50 and the free piston/adjustment member 90 will be greater than the length of pins 69,98. However, as a door to which the closer is fitted is moved towards a position in which it approaches an angle of approximately 180° relative its associated door frame, the piston 50 and the free piston/adjustment member 90 will move towards the mounting plate 12 and the gap between them will diminish. When the door is open to its fullest extent, the distance between the adjacent faces of the two pistons may be less than the combined length of a pair of pins 69,98. Rotation of the free piston/adjustment member 90, by means of a screwdriver blade applied to the slot **95*a* will bring the pins 98 carried by the free piston/adjustment member 90 into lateral abutment with the pins 69 carried by the support plate 65, and thereafter continued rotation of the free piston/adjustment member 90 will rotate the support plate 65 relative to the associated disc 61, thereby adjusting the position of the notch 67 relative to the arcuate slot 63 as previously described in relation to the FIG. 2** embodiment.

If the door is opened to an extent such that the pins 69,98 do not "overlap" in this way, then the free piston/adjustment member 90 can be displaced axially, by the application of end-wise pressure to the spigot 95 until the ends of the pins 98 come into contact with the face of the support plate 65. Thereafter, the free piston/adjustment member 90 can be rotated as previously described.

The free ends of the pins 69,98 are preferably bevelled, as shown so that should the opposed pairs of pins by chance come into end-to-end contact with one another, the bevelled faces will have a cam action which will cause the support plate 65 to be displaced slightly in the circumferential direction to enable the pairs of pins become aligned side-by-side as the free piston/adjustment member continues to be advanced.

In further modifications, applicable to the previously described embodiments, the fixed disc 61 of the flow restriction assembly may be omitted and instead the arcuate slot may be formed by a groove in either the end face of the piston 50 or in the face of the plate 65 in contact with the piston.

Where such a groove is formed in the end face of the piston it may take substantially the same form as the slot 63 except that the inward extension 64 opens directly into the recess 57, the piston 50 being carried on the rod 42 in a manner such that it is fixed against rotation relative thereto, and the plate 65 being unchanged.

Where such a groove is formed in the plate 65, it will be understood that the notch 67 will be located at one end of such groove and in communication therewith, and instead of the groove terminating at the other end in the inward extension 64, a similar short groove will be formed in the end face of the piston 50 to extend radially outwardly from the recess 57 and intersect the arcuate groove.

Figure 5:
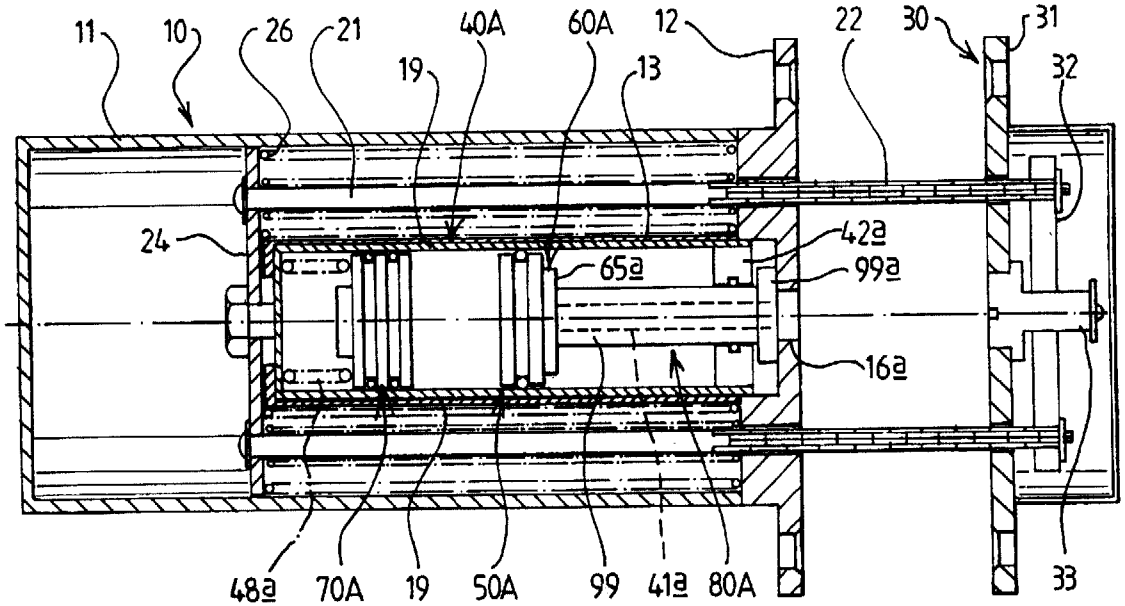
FIG. 5 is a diagrammatic illustration of an alternative embodiment in which the piston and piston rod are fixed components.

In the above-described embodiments the piston 50 is carried by the cross-head 24 and is slidably received within a stationary cylinder, but the converse arrangement is possible and FIG. 5 illustrates an alternative embodiment of closer which is generally similar to those described above, except that it employs a modified damper 40A in which a cylinder 19 is slidable within the central bore 13 over a fixed piston 50A, and the cross-head 24 is connected to the cylinder 19. The damper 40A is similar in construction and function to the damper 40 previously described, further description being confined to the modified adjustment member 80A and parts associated therewith. Parts similar to those previously described are identified by the same reference numbers.

Because the piston 50A is fixed in position relative to the mounting plate 12, the adjustment member 80A does not require to be axially adjustable to engage the support plate 65*a* of the flow restriction assembly 60A on the fixed piston 50A. Instead, the support plate 65*a* is carried by an adjustment member comprising a tubular shaft 99 which is mounted on a fixed piston rod 41*a* which is itself secured in a modified central opening 16*a* in the mounting plate 12. Externally of a bushing 42*a*, which in this case closes the end of the damper adjacent to the mounting plate 12, the tubular shaft 99 is formed with a radial flange 99*a* which serves as an operating wheel whereby the tubular shaft 99 can be rotated on the fixed piston rod 41*a*. The flange 99*a* may be of toothed form around its periphery and a slot (not shown) may be formed in the mounting plate in register with part of the periphery of the flange 99*a* so that the teeth thereof may be engaged by a suitable tool to facilitate rotation of the flange and the tubular shaft of which it forms part.

In such an arrangement, the damper can be adjusted when the door is opened by only about 90°, i.e. sufficient to obtain access to the flange 99*a*.

The features disclosed in the foregoing description, or the accompanying drawings, expressed in their specific forms or in terms of a means for performing the disclosed function, or a method or process for attaining the disclosed result, may, separately or in any combination of such features, be utilised for realising the invention in diverse forms thereof.

We claim:

1. A door closer comprising:

(a) an actuator comprising a housing adapted for fitting within the thickness of a door and having a mounting plate for securing to an edge face of the door at which the door is hinged;

(b) an anchor member adapted for fitting in a door frame in opposed relation to said edge face of the door;

(c) a tension member slidably movable within the actuator housing under the action of spring means and coupled to said anchor member so that said spring means acts to draw the housing and the anchor member together such that, when installed, the closer acts to draw the door towards and into a position of closure relative to the door frame; and (d) a fluid-filled damper coupled to said tension member and arranged to regulate the rate of movement of the tension member under the force of said spring means at least in a door-closing direction, the damper comprising:

(i) a cylinder containing hydraulic fluid;

(ii) a piston slidable longitudinally of said cylinder and dividing the cylinder into two chambers;

(iii) a piston rod carrying said piston and extending beyond said cylinder at one end thereof; and (iv) a flow-restricting passageway incorporated in said piston to limit the rate of flow of hydraulic fluid from one of said chambers to the other at least when the tension member is moving in the door-closing direction, said passageway being defined by two elements in combination;

wherein:

(e) the flow restriction imposed on the hydraulic fluid by said passageway is variable by relative positional adjustment of said two passageway-defining elements and an adjustment member is provided within the cylinder to enable one of said passageway-defining elements to be positionally adjusted relative to the other so as to vary the flow restriction imposed on the hydraulic fluid by said passageway, the adjustment member having an operating element which is accessible at said actuator mounting plate.

2. A door closer according to claim 1 wherein the passageway includes an arcuate slot of variable effective length, adjustment of the effective length of the slot controlling the flow restriction imposed by said passageway.

3. A door closer according to claim 2 wherein the passageway-defining elements comprise respective discs, one of which is formed with said arcuate slot centred on the axis of the piston rod and held against rotation relative to said piston rod, one end of the slot communicating with a through-bore formed in said piston, and the other of which discs is formed with a through-aperture to register with said arcuate slot, whereby rotation of the apertured disc varies the effective length of the slot (between the through-bore of the piston and the aperture), engagement of the adjustment member and the apertured disc enabling the apertured disc to be rotated relative to the slotted disc.

4. A door closer according to claim 2 wherein the passageway-defining elements comprise a body of said piston and a disc rotatably mounted on an end face of said piston, the slot being formed in combination by said piston and said disc, and the disc is formed with a through-aperture in register with said slot, and the slot also communicating with a through-bore formed in said piston.

5. A door closer according to claim 4 wherein said slot is formed by a groove in a face of said disc which is in contact with said end face of the piston.

6. A door closer according to claim 4 wherein said slot is formed by a groove in said end face of the piston.

7. A door closer according to claim 2 wherein the cylinder has an open end adjacent to said mounting plate and a closed end, said piston rod extends away from the mounting plate through a seal at the closed end of the cylinder which defines one end of one of said chambers, and the cylinder contains between said piston and its open end an additional, free piston which defines one end of the other of said chambers.

8. A door closure according to claim 7 wherein said adjustment member is carried by said free piston for longitudinal movement relative to said free piston so as to be engageable with one of said passageway-defining elements for the purpose of positional adjustment thereof, the operating element of the adjustment member extending through said free piston towards said open end of the cylinder.

9. A door closer according to claim 8 wherein the free piston is formed with a central bore in which the adjustment member is slidably and rotatably received.

10. A door closer according to claim 7 wherein the free piston is adapted to serve as said adjustment member.

11. A door closer according to claim 5 the operating element of the adjustment member is disposed at the end of the free piston nearer to the mounting plate and includes a formation adapted to co-operate with an adjusting tool which can be inserted through an aperture formed in said mounting plate whereby the adjustment member can be moved longitudinally if necessary into engagement with one of said passageway-defining elements, and rotationally so as to adjust the circumferential position of said passageway defining element.

12. A door closer according to claim 2 wherein the adjustment member is formed or provided with an axially extending pin which is adapted to be engaged in a recess formed in one of said passageway-defining elements at a position radially offset from the axis of said cylinder.

13. A door closer according to claim 2 wherein said adjustment member is formed or provided with at least one axially extending pin at a position radially offset from the axis of said cylinder, and one of said passageway-defining elements is formed with at least one axially extending pin directed towards said adjustment member at a position radially offset from the axis of said cylinder by a distance substantially equal to that of said pin carried by the adjustment member so that said pins can be brought into lateral engagement.

14. A door closer according to claim 13 wherein the ends of said pins are chamfered.

15. A door closer according to claim 2 wherein the piston rod is secured immovably relative to the mounting plate, and the cylinder is coupled to the tension member.

16. A door closer according to claim 15 wherein the adjustment member comprises a tubular shaft mounted on the fixed piston rod and carrying at its inner end one of said passageway-defining elements, said operating element being provided at the outer end of the tubular shaft.

17. A door closer according to claim 1 wherein said passageway-defining elements comprise a first element which defines a bore and a second element arranged co-axially within said bore so that the passageway is of annular form, with a minimum cross-sectional area which is variable by relative longitudinal adjustment of the two elements.

18. A fluid filled damper comprising:

(i) a cylinder containing hydraulic fluid;

(ii) a piston slidable longitudinally of the cylinder and dividing the cylinder into two chambers;

(iii) a piston rod carrying said piston and extending beyond said cylinder at one end thereof; and (iv) a flow-restricting passageway incorporated in said piston to limit the rate of flow of hydraulic fluid from one of said chambers to the other at least in one direction of flow, said passageway being defined by two elements in combination;

wherein:

(v) the flow restriction imposed on the hydraulic fluid by said passageway is variable by relative positional adjustment of said two passageway-defining elements, and an adjustment member is provided within the cylinder to enable one of said passageway-defining elements to be positionally adjusted relative to the other so as to vary the flow restriction imposed on the hydraulic fluid by said passageway, the adjustment member having an operating element which is accessible endwise of the cylinder.

19. A damper according to claim 18 wherein the passageway includes an arcuate slot of variable effective length, adjustment of the effective length of the slot controlling the flow restriction imposed by said passageway.

20. A damper according to claim 19 wherein the passageway-defining elements comprise respective discs, one of which is formed with said arcuate slot centred on the axis of the piston rod and held against rotation relative to said piston rod, one end of the slot communicating with a through-bore formed in said piston, and the other of which discs is formed with a through-aperture to register with said arcuate slot, whereby rotation of the apertured disc varies the effective length of the slot (between the through-bore of the piston and the aperture), engagement of the adjustment member and the apertured disc enabling the apertured disc to be rotated relative to the slotted disc.

21. A damper according to claim 19 wherein the passageway-defining elements comprise a body of said piston and a disc rotatably mounted on an end face of said piston, the slot being formed in combination by said piston and said disc, and the disc is formed with a through-aperture in register with said slot, and the slot also communicating with a through-bore formed in said piston.

22. A damper according to claim 21 wherein said slot is formed by a groove in a face of said disc which is in contact with said end face of the piston.

23. A damper according to claim 21 wherein said slot is formed by a groove in said end face of the piston.

24. A damper according to claim 19 wherein the cylinder has an open end and a closed end, said piston rod extends through a seal at the closed end of the cylinder which defines one end of one of said chambers, and the cylinder contains between said piston and its open end an additional, free piston which defines one end of the other of said chambers.

25. A damper according to claim 24 wherein said adjustment member is carried by said free piston for longitudinal movement relative to said free piston so as to be engageable with one of said passageway-defining elements for the purpose of positional adjustment thereof, the operating element of the adjustment member extending through said free piston towards said open end of the cylinder.

26. A damper according to claim 25 wherein the free piston is formed with a central bore in which the adjustment member is slidably and rotatably received.

27. A damper according to claim 24 wherein the free piston is adapted to serve as said adjustment member.

28. A damper according to claim 19 wherein the adjustment member is formed or provided with an axially extending pin which is adapted to be engaged in a recess formed in one of said passageway-defining elements at a position radially offset from the axis of said cylinder.

29. A damper according to claim 19 wherein said adjustment member is formed or provided with at least one axially extending pin at a position radially offset from the axis of said cylinder, and one of said passageway-defining elements is formed with at least one axially extending pin directed towards said adjustment member at a position radially offset from the axis of said cylinder by a distance substantially equal to that of said pin carried by the adjustment member so that said pins can be brought into lateral engagement.

30. A door closer according to claim 29 wherein the ends of said pins are chamfered.

* * * * *

UNITED STATES PATENT AND TRADEMARK OFFICE

CERTIFICATE OF CORRECTION

PATENT NO. : 5,706,551

DATED : January 13, 1998

INVENTOR(S) : Roger Henry Jeynes and John Humpherson

It is certified that error appears in the above-identified patent and that said Letters Patent is hereby corrected as shown below:

Column 1 Line 10 "Within" should read --within--.

Column 6 Line 50 "various" should read --varies--.

Column 7 Line 3 after "defined" delete period --.--.

Column 9 Line 13 after "90° position" insert --to--.

Column 9 Line 17 "Variable" should read --variable--.

Claim 11 Column 13 Line 14 after "claim 5" insert --wherein--.

Signed and Sealed this

Twenty-sixth Day of May, 1998

*Attest:*

*Attesting Officer*

BRUCE LEHMAN

*Commissioner of Patents and Trademarks*